United States Patent [19]

Kraft et al.

[11] Patent Number: 4,567,679

[45] Date of Patent: Feb. 4, 1986

[54] STEAM IRON HAVING A MULTI-CHAMBERED TANK

[75] Inventors: Adolf Kraft, Obertshausen; Rudolf Schneider, Hanau, both of Fed. Rep. of Germany

[73] Assignee: Rowenta-Werke, GmbH, Fed. Rep. of Germany

[21] Appl. No.: 689,612

[22] Filed: Jan. 8, 1985

[30] Foreign Application Priority Data

Jan. 13, 1984 [DE] Fed. Rep. of Germany ..... 3401045
Aug. 14, 1984 [DE] Fed. Rep. of Germany ..... 3429840
Oct. 16, 1984 [DE] Fed. Rep. of Germany ..... 3437825

[51] Int. Cl.[4] ..... D06F 75/18
[52] U.S. Cl. ..... 38/77.82; 219/273
[58] Field of Search ..... 219/273, 271; 38/77.82, 38/77.83, 77.8, 77.81

[56] References Cited

U.S. PATENT DOCUMENTS 2,817,912 12/1957 Schott et al. ..... 38/77.83
4,079,528 3/1978 Lindstaedt et al. ..... 38/77.83

FOREIGN PATENT DOCUMENTS 1366852 9/1974 United Kingdom ..... 38/77.83
2065176 6/1981 United Kingdom ..... 38/77.82

*Primary Examiner*—Werner H. Schroeder
*Assistant Examiner*—Andrew M. Falik
*Attorney, Agent, or Firm*—Clifford A. Dean; Neil M. Rose

[57] ABSTRACT

An electrically heated steam iron operable by a drip system includes a drip valve arranged to have a variable rate of flow of water therethrough, and a water tank the interior of which is vertically divided into two chambers and by a partition wall, the two chambers being in flow communication with each other via an opening. A vaporizing chamber is disposed below the drip valve. A vertically adjustable slide member is arranged to slide relative to the partition wall while being sealingly engaged therewith, and adjustment means comprising a valve rod is connected to the slide member. The valve rod passes through a top surface of the tank, wherein vertical adjustment of said slide member by means of the valve rod is effective to vary the height of the column of water above the drip valve, thereby adjusting the rate of flow of water.

9 Claims, 7 Drawing Figures

STEAM IRON HAVING A MULTI-CHAMBERED TANK

Figure 1:
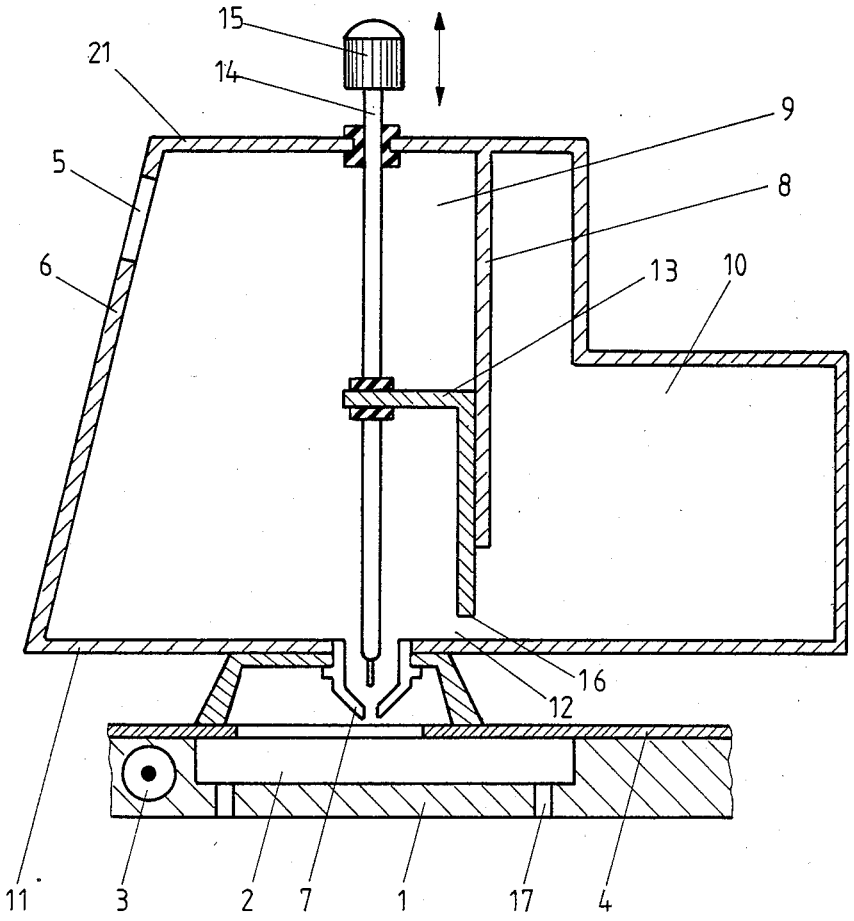

The invention relates to an electrically heated steam iron operable by a drip system, including a drip valve and a water tank the interior of which is divided into at least two chambers, two such chambers being in flow communication with each other.

A steam iron is already known wherein the water tank is divided by a partition wall into a front chamber and a back chamber. The front chamber is connected to atmosphere through the fill opening and the inner space of the back chamber communicates with a vaporizing chamber through a connecting tube. A drip valve is arranged in the front chamber. For ironing with steam, water is supplied to the heated vaporizing chamber from the tank. In this vaporizing chamber, the water is converted from liquid into steam. Thanks to the connecting tube, the same pressure conditions prevail in the vapor chamber and in the back chamber of the water tank. When there is excess pressure, water is conveyed from the back chamber into the front chamber, so that the water level rises in this chamber and the static pressure of the column of water bearing on the drip valve is increased. The column of water above the drip valve is maintained at a constant level, irrespective of the water level in the back chamber, throughout the steam ironing operation until the water level in the back chamber falls to the level of the lower edge of the partition wall. This serves to even out the quantity of water flowing in from the tank to the vaporizing chamber and thus also evens out the quantity of vapor produced. A disadvantage of this steam iron is the fact that, when ironing with steam, the height of the column of water over the drip valve and hence the quantity of water flowing into the vaporizing chamber from the tank cannot be altered.

Viewed from one aspect, the invention provides an electrically heated steam iron operable by a drip system, including a drip valve, a water tank the interior of which is vertically divided into at least two chambers, two such chambers being in flow communication with each other via an opening in a partition wall, a vertically adjustable slide member arranged to slide relative to said wall in the region of said opening while being sealingly engaged with said wall, and adjustment means connected to the slide member and passing through an outer wall of the tank, wherein vertical adjustment of said slide member via said adjustment means is effective to vary the height of the column of water above the drip valve, thereby adjusting the rate of flow of water therethrough.

At least in the preferred embodiments of the invention, the influx of water from the water tank of the steam iron into a vaporizing chamber thereof can be varied between a minimum and a maximum, while the outflow quantity selected remains constant, and unaffected by the level of filling of the water storage container. The static pressure of the water column bearing on the drip valve and hence the quantity of water flowing out of the water tank into the vaporizing chamber in the operating position of the steam iron may be varied by adjusting means which can be actuated from the outside. The outflow quantity selected can then remain constant, irrespective of the level of filling of the tank.

In a preferred embodiment, it has been found that the rate of flow of water through the drip valve can be varied between a minimum and a maximum by means of a slide member which is arranged to form a seal against a vertical partition wall in the water tank and which can be adjusted vertically by means of a lifting mechanism. In such an embodiment the height of the column of water is limited by the lower edge of the slide member and by the valve outlet and remains unaffected by the level of water in the water tank. This column bears on the valve throughout the steam ironing operation. If the slide member is raised, the hydrostatic pressure of the water column is increased and causes the quantity of water flowing into the vaporizing chamber to increase. If, on the other hand, the slide member is lowered, the hydrostatic pressure of the column of water bearing on the valve is reduced, thereby also reducing the quantity of water flowing out of the valve. The height of the column of water is determined, in such an embodiment of the invention, by the position of the lower edge of the slide member above the drip valve. The lower edge of the slide member and hence the hydrostatic pressure are infinitely adjustable by means of suitable devices between a minimum and a maximum.

Preferably, a slide member the height of which can be vertically adjusted is provided against the partition wall in the region of an opening therethrough. This adjustment may be carried out by means of a lifting rod which passes through the top surface of the water tank and can be operated from outside. To simplify the construction, the valve rod of the drip valve may be used as the lifting rod. Advantageously, the fill opening of the tank can be closed off and a pressure equalising tube between the vaporizing chamber and the interior of the tank is provided in the front chamber. When the water flowing into the heated vaporizing chamber is converted from the liquid to the vapor phase, the same pressure prevails in the vaporizing chamber and in the interior of the tank, as is well known. This evens out the quantity of water flowing into the vaporizing chamber from the tank and thus also evens out the quantity of vapor produced.

Viewed from another aspect, the invention provides an electrically heated steam iron operable by a drip system, including a drip valve arranged above a vaporizing chamber, a water tank the interior of which is vertically divided by a partition wall into two chambers, said partition wall comprising a tubular member connected at one end to the top of the water tank and extending downwardly to an open end above the base of the tank such that the two chambers are in flow communication with each other, a U-shaped tube fixed to and projecting from said tank base into the tubular member, one leg of said U-shaped tube being connected to said vaporizing chamber and the other leg of the U-shaped tube having an open end above said tank base, a cylindrical valve the external diameter of which is smaller than the internal diameter of said other leg of the U-shaped tube, the cylindrical valve being movably guidable in a seal in a top surface of the U-shaped tube and the inner regions of the cylindrical valve and the tubular member being connected to one another through an opening, and adjustment means connected to the cylindrical valve and passing through an outer wall of the tank, wherein vertical adjustment of said cylindrical valve via said adjustment means is effective to vary the height of the column of water above the drip valve thereby adjusting the rate of flow of water therethrough. With such an arrangement, the hydrostatic pressure of the column of water bearing on the drip valve and thus the quantity of water flowing into the vaporizing chamber can be varied between a minimum and a maximum.

In a preferred embodiment of the invention, a steam iron is provided wherein the legs of the U-shaped tube comprise two tubes fixed to the tank base and projecting into the tubular member, the inner regions of these tubes being in flow communication with each other, a channel connecting one of said tubes to said vaporizing chamber, and wherein the drip valve is disposed in the tank base below the other of said tubes, the wall of said other tube having an opening in the region of the tank base, and the external diameter of said cylindrical valve being smaller than the internal diameter of said other tube.

Preferably, both tubes are sealed off relative to the interior of the tank by means of a flexible closure seal. This seal may have a sealing lip which abuts on the outer surface of the cylindrical valve. The seal is advantageously in the form of a concertina which follows the lifting movements of the cylindrical valve and reliably continues to perform its sealing function.

Viewed from another aspect, the invention provides an electrically heated steam iron operable by a drip system, including a drip valve, a water tank the interior of which is vertically divided into at least two chambers, two such chambers being in flow communication with each other via an opening, said drip valve including a valve member fixedly connected to a valve rod, said valve member being vertically adjustable in an inlet connection of a vaporizing chamber, and a valve needle of the drip valve being fixed in the wall of the water tank, wherein vertical adjustment of said valve member is effective to vary the height of the column of water above the valve member, thereby adjusting the rate of flow of water therethrough.

In such an arrangement the valve member fixed to the valve rod may be adjusted vertically from outside by actuating the valve rod and in this way the quantity of water flowing through the drip valve can be varied between a minimum and a maximum. Preferably, said two chambers are divided by a partition wall having a lower edge providing an opening therebeneath to put said two chambers in flow communication. During steam ironing, the height of the column of water, which is limited by the lower edge of the partition wall and the valve outlet and is not affected by the level of filling of the tank, bears on the valve. If the valve member is raised, the hydrostatic pressure of the column of water falls and causes a reduction in the quantity of water flowing into the vaporizing chamber. When the valve member is lowered, on the other hand, the hydrostatic pressure of the column of water bearing on the valve is increased, thereby also increasing the quantity of water flowing through the valve. The valve member is guided in the inlet connection of the vaporizing chamber. In a preferred embodiment, a guide element is provided in the form of a seal connected to the valve member and the valve bore in the valve member is of conical construction in the region of the valve needle in order to ensure that the valve needle can be inserted into the valve bore even with small manufacturing tolerances. In order to close off the drip valve or clean the bore to remove any lime residues, the valve member may be raised by means of the valve rod and brought into operative connection with the valve needle. Advantageously, the inlet connection may be constructed as a resiliently deformable concertina and the valve member may be connected to the inlet connection.

Certain embodiments of the invention will now be described, by way of example only, with reference to the accompanying drawings in which: FIG. 1 shows a diagrammatic sectional view of part of a steam iron in accordance with the invention; and FIGS. 2 to 7 each show similar views of other embodiments of the invention.

The part of the steam iron shown in FIG. 1 shows part of the sole plate 1, the vaporizing chamber 2 and the heating element 3. The vaporizing chamber 2 is closed off by a cover 4. The water storage tank 6 which can be filled through the fill opening 5 is arranged above the sole plate 1. During steam ironing, water is conveyed from the tank 6 through the drip valve 7 into the vaporizing chamber 2. For dry ironing, i.e. ironing without steam, the supply of water is interrupted by closing the drip valve 7. The interior of the tank is divided by a partition wall 8 into the chamber 9 which is under atmospheric pressure and the chamber 10 which is not directly connected to atmosphere. The throughflow opening 12 is located between the base 11 of the tank and the partition wall 8.

A slide or slide member 13 is mounted on the partition wall 8 so as to be vertically movable and adjustable in height. Surprisingly, no additional seal is required between the slide 13 and the partition wall 8 since the capillary forces of the water are sufficient to render a seal unnecessary. The slide 13 is operatively connected to the valve rod 14. In order to open and close the drip valve 7 and actuate the slide 13, the valve rod 14 is movable in the direction of the arrows from outside by means of the actuating knob 15.

With the aid of the slide 13, in the operating position of the iron, the hydrostatic pressure of the column of water bearing on the drip valve 7 and hence the quantity of water flowing out of the water storage tank 6 into the vaporizing chamber 2 can be infinitely adjusted between a maximum and a minimum. The height of the column of water is limited by the lower edge 16 of the slide and the valve outlet of the drip valve 7. The slide 13 can be moved from outside by means of the actuating knob 15. After the drip valve 7 has been opened the water level in the chamber 9 falls until it reaches the lower edge 16 of the slide. The quantity of water flowing through which is set in this manner remains constant, independently of the water level in the chamber 10, until this water level falls to the lower edge 16 of the slide 13. The fact that the quantity of water flowing through can be varied means that the quantity of steam leaving the steam exit holes 17 can also be regulated.

Figure 2:
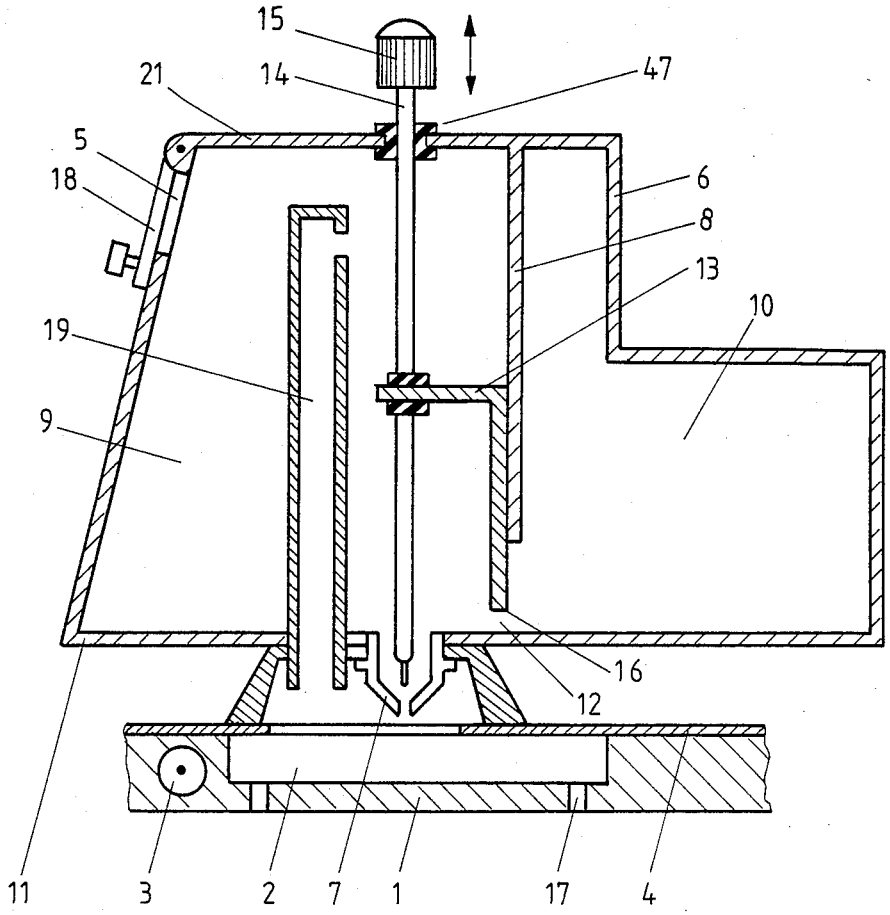

In the embodiment shown in FIG. 2, the fill opening 5 of the water tank 6 is tightly sealed off during steam ironing by means of a valve 18. The valve rod 14 is guided in a seal 47 in the top surface 21 of the water tank 6. Between the vaporizing chamber 2 and the interior of the chamber 9 is provided a connecting tube 19 the opening of which ends above the water level in the chamber 9. The water flowing into the heated vaporizing chamber 2 is converted in this chamber 2 from the liquid to the vapor phase. The pressure thus produced also prevails in the chamber 9 which is not in communication with atmosphere, thanks to the arrangement of the connecting tube 19. This evens out the quantity of water flowing out of the tank 6 into the vaporizing chamber 2 during steam ironing and thus also evens out the quantity of steam which is conveyed to the material being ironed through the steam exit holes 17 provided in the sole plate 1. The apparatus for varying the hydrostatic pressure of the column of water bearing on the drip valve 7 and thus for adjusting the quantity of water which is to be supplied to the vaporizing chamber 2 corresponds to the apparatus shown in FIG. 1.

Figure 3:
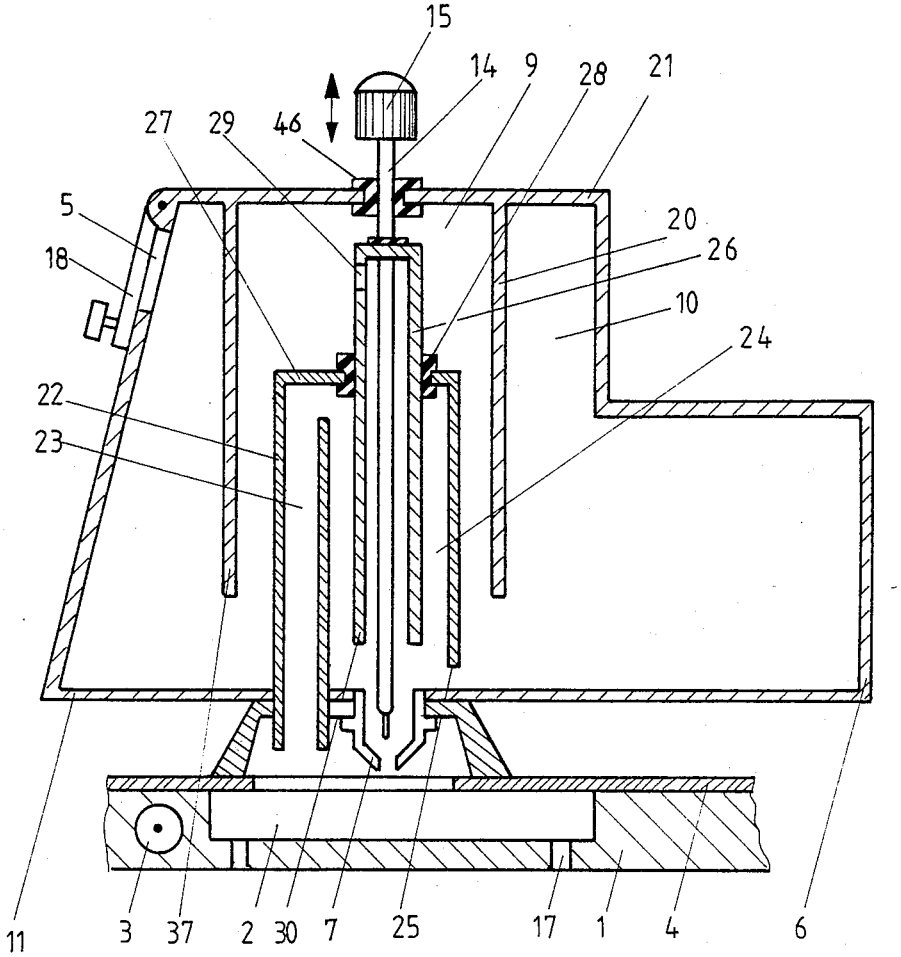

In the embodiment shown in FIG. 3, the partition wall is a tubular member 20 which is open at one end and which is connected to the top surface 21 of the water tank 6. The free end of the tubular member 20 opens out above the base 11 of the tank. Fixed to the base 11 of the tank is a U-shaped tube or U-tube 22 projecting into the tubular member 20. The leg 23 of the U-tube 22 is connected to the vaporizing chamber 2, while the leg 24 of the U-tube 22, forming an annular gap 25 with the base 11 of the tank, opens out above the base 11 of the tank. A sliding cylindrical valve 26 is fixed to the valve rod 14 and is disposed inside the leg 24 of the U-tube 22. The sliding cylindrical valve 26 is movably guided in vertically adjustable manner in the top surface 27 of the U-tube 22 in the seal 28 and the valve rod 14 is movably guided in the top surface 21 of the water tank 6 of the seal 46. The sliding cylindrical valve 26 is of hollow construction and its external diameter is smaller than the internal diameter of the leg 24. An opening 29 in the wall of the sliding cylindrical valve connects the inner region of the sliding cylindrical valve 26 to the chamber 9. With the aid of the sliding cylindrical valve 26, the quantity of water flowing out of the tank 6 through the drip valve 7 into the vaporizing chamber 2 can be varied. In the rest position of the steam iron and when the water tank 6 is full, the water is at the same level within the chamber 10 and the leg 24 since they are connected by the annular gap 25. Within the sliding cylindrical valve 26 and the chamber 9, which are connected by means of the opening 29, the water level is lower since the air enclosed here counteracts the tendency of the water to reach a uniform level in all the chambers.

For ironing with steam, the drip valve 7 is opened and the water flowing into the vaporizing chamber is converted from liquid into steam. Steam flows out of the vaporizing chamber 2 through the leg 23 into the leg 24 and presses on the surface of the column of water in leg 24. Consequently, the column of water within the leg 24 falls to the lower edge 30 of the sliding cylindrical valve 26. The steam which continues to flow in crosses the lower edge 30 and rises upwards within the sliding cylindrical valve 26 and through the opening 29 into the chamber 9, where it mixes with the air present above the surface of the water. A slight overpressure is produced within the chamber 9, causing the water level within the chamber 9 to be lowered as far as the lower edge 37 of the tubular member 20. The mixture of steam and air produced in the chamber 9 then bubbles under the lower edge 37 of the tubular member 20 into the chamber 10. As it passes through the water in the chamber 10, the mixture cools off and some of the steam condenses to form water. Nevertheless, overpressure is also produced in the chamber 10. In this state, the hydrostatic height above the drip valve 7 which determines the steam production is determined by the lower edge 30 of the sliding cylindrical valve 26 and, like the steam production, remains constant until the level in the tank falls below the lower edge 30 of the sliding cylindrical member 26. The flow of water through the drip valve 7 and hence the steam production of the steam iron can be varied by raising or lowering the sliding cylindrical valve as in the embodiments shown in FIGS. 1 and 2.

If the steam iron is placed on its heel during use, as is common practice when ironing, the pressure conditions which existed previously break down. When steam ironing is resumed, the optimum pressure conditions are re-established very quickly with the apparatus according to the invention. Thanks to the tubular member 20, even in the resting position, the column of water bearing on the drip valve 7 is lower than the water level within the water tank 6, with the result that the quantity of water selected by the user flows into the vaporizing chamber through the valve system according to the invention without being influenced by the level of filling of the water tank and, after its aggregate nature has been changed, it leaves the sole plate of the iron in the form of steam.

Figure 4:
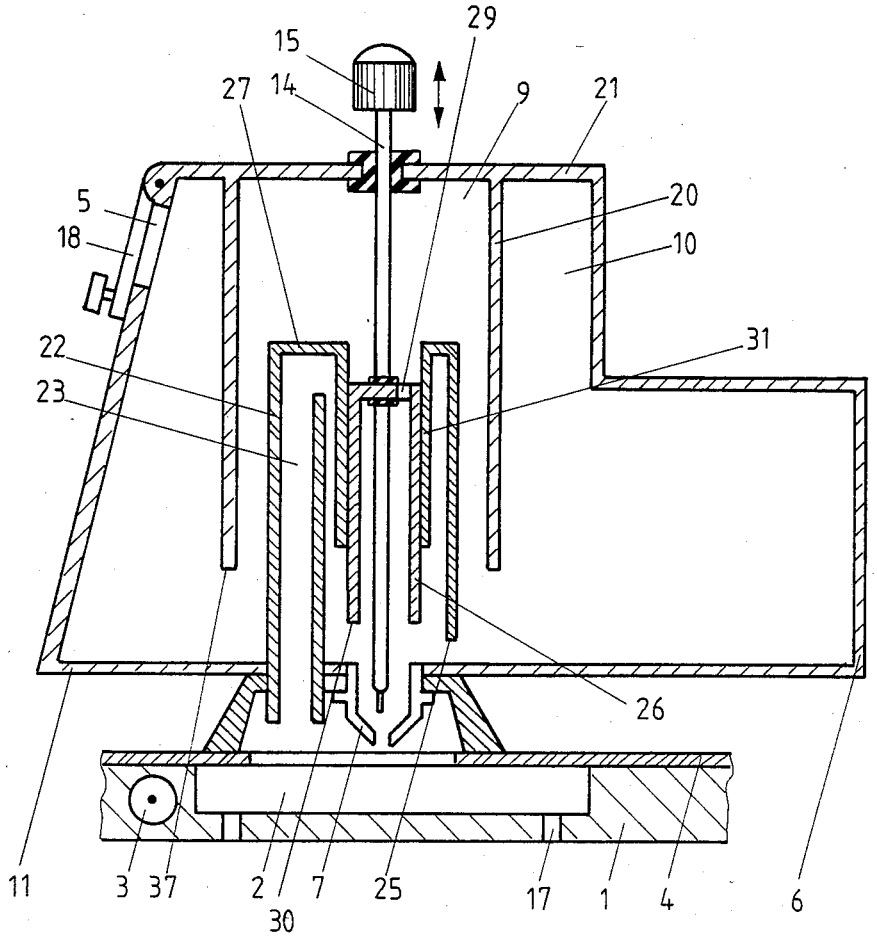

FIG. 4 shows an embodiment of the invention by way of example in which a guide connection 31 is formed on the top surface 27 of the U-tube 22. The sliding cylindrical valve 26 is movably mounted in the guide connection 31. As a result of the small clearance between the sliding cylindrical valve 26 and the guide connection 31, there is no need for any additional sealing of the sliding cylindrical valve 26. The method of operation of this embodiment is the same as for the embodiment shown in FIG. 3.

Figure 5:
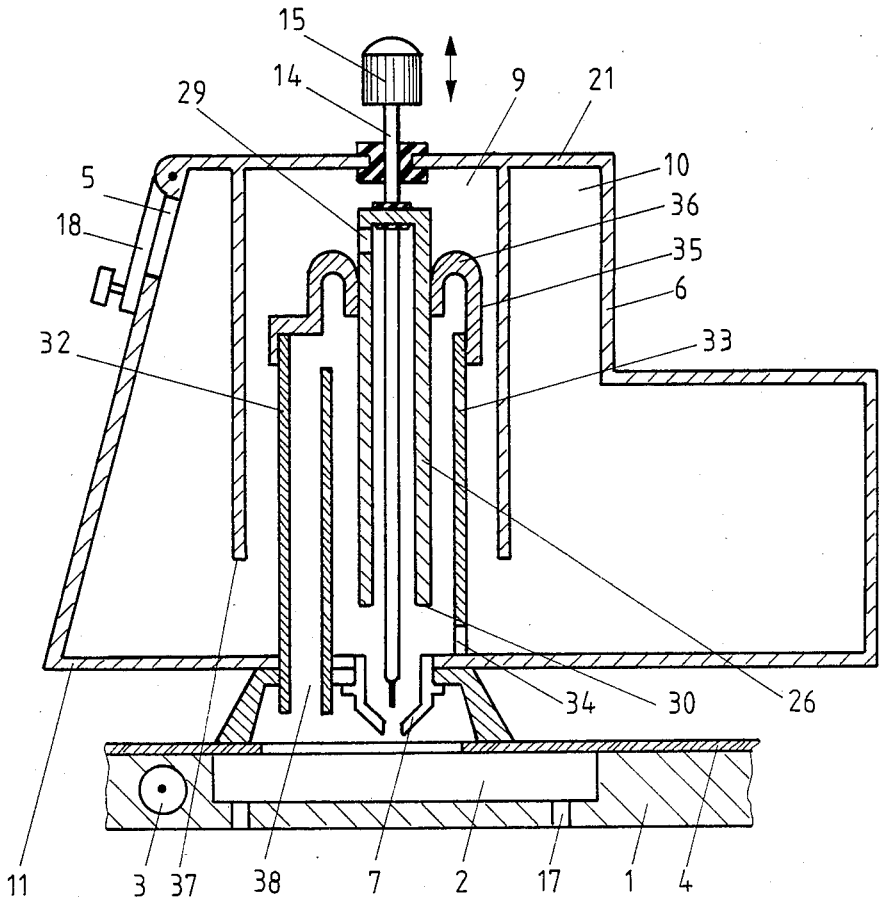

Another embodiment of the invention is shown in FIG. 5. Fixed to the base 11 of the tank are two tubes 32, 33 projecting into the chamber 9, the inner regions of which are connected to one another. The drip valve 7 is fixed below the tube 33 in the base of the tank. The tube 32 is connected to the vaporizing chamber 2 by a channel 38, whilst the tube 33 has an opening 34 in the region of the base 11 of the tank. The sliding cylindrical valve 26 is fixed in vertically adjustable manner to the valve rod 14. An opening 29 connects the interior of the sliding cylindrical valve 26 with the chamber 9. The external diameter of the sliding cylindrical valve is smaller than the internal diameter of the tube 33 and the valve is disposed inside the tube. The lower edge of the sliding cylindrical valve forms an annular gap with the base of the tank and since the sliding cylindrical valve is fixed to the valve rod 14 and is vertically adjustable by means of the valve rod, the annular gap between the base of the tank and the lower edge of the sliding cylindrical valve and hence the hydrostatic pressure of the column of water bearing on the valve can be varied. The tubes 32 and 33 are sealed off from the interior of the tank by means of an elastic closure 35. Formed on the closure 35 is a sealing lip 36 which abuts on the outer surface of the sliding cylindrical valve 26. The closure 35 is concertina-shaped and follows every movement of the sliding cylindrical valve 26 while continuing to perform its sealing function. This apparatus functions in the same way as the embodiment shown in FIG. 3 but has significant advantages from the manufacturing point of view.

Figure 6:
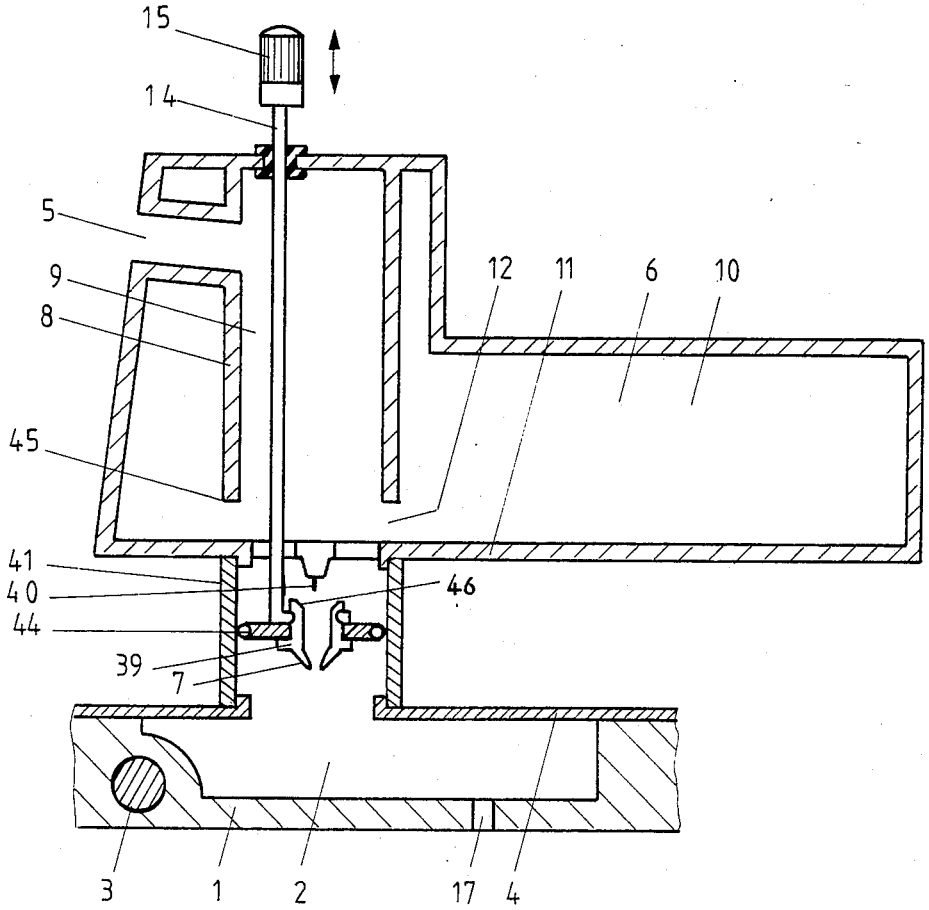

FIG. 6 shows another embodiment in which the interior of the tank is divided by a partition wall 8 into the chamber 9 which is under atmospheric pressure and the chamber 10 which is not connected to atmosphere. Between the tank base 11 and the partition wall 8 is the opening 12 which connects the two chambers. The drip valve 7 consists of a valve member 39, valve rod 14 and valve needle 40. The valve needle 40 is fixedly connected to the tank base 11 and the valve bore 46 of the valve member 39 is conical to aid the insertion of the valve needle 40. The valve member 39 is fixedly connected to the valve rod 14 and guided in the inlet connection 41 to the vaporizing chamber 2. A flexible seal 44 is fixed to the valve member 39. The seal 44 abuts with its circumferential edge on the inner wall of the inlet connection 41, thus guiding the valve member 39 in the inlet connection 41 in leaktight manner. In order to open and close the drip valve 7 and vary the quantity flowing through the drip valve 7, the valve rod 14 is movable in the direction of the arrows from outside by means of the actuating knob 15. Owing to the fact that the valve member 39 is vertically movable, in the operating position of the iron the hydrostatic pressure of the column of water bearing on the drip valve 7 and hence the quantity of water flowing out of the water tank 6 into the vaporizing chamber 2 can be varied between a maximum and a minimum. The height of the column of water is limited by the lower edge 45 of the partition wall and the valve outlet of the drip valve 7. After the drip valve 7 has been opened, the water level in the chamber 9 falls to the lower edge 45 of the partition wall. The quantity of water flowing through which is set in this way remains constant, irrespective of the water level in the chamber 10, until this water level falls to the lower edge 45 of the partition wall 8. The throughflow rate selected can be varied by vertically adjusting the valve member 39. If the valve member 39 is raised, the hydrostatic pressure of the column of water is reduced and this in turn reduces the throughflow rate. If the valve member 39 is lowered, the hydrostatic pressure of the column of water bearing on the valve is increased, thereby increasing the quantity of water flowing through the valve 7. As the throughflow of water can be varied, the quantity of steam leaving the steam exit holes 17 can be regulated. In order to close the valve 7 the valve member 39 is raised towards the valve needle 40 which is fixedly mounted in the tank base 11. The valve needle 40 then passes through the valve bore 46 and closes the valve.

Figure 7:
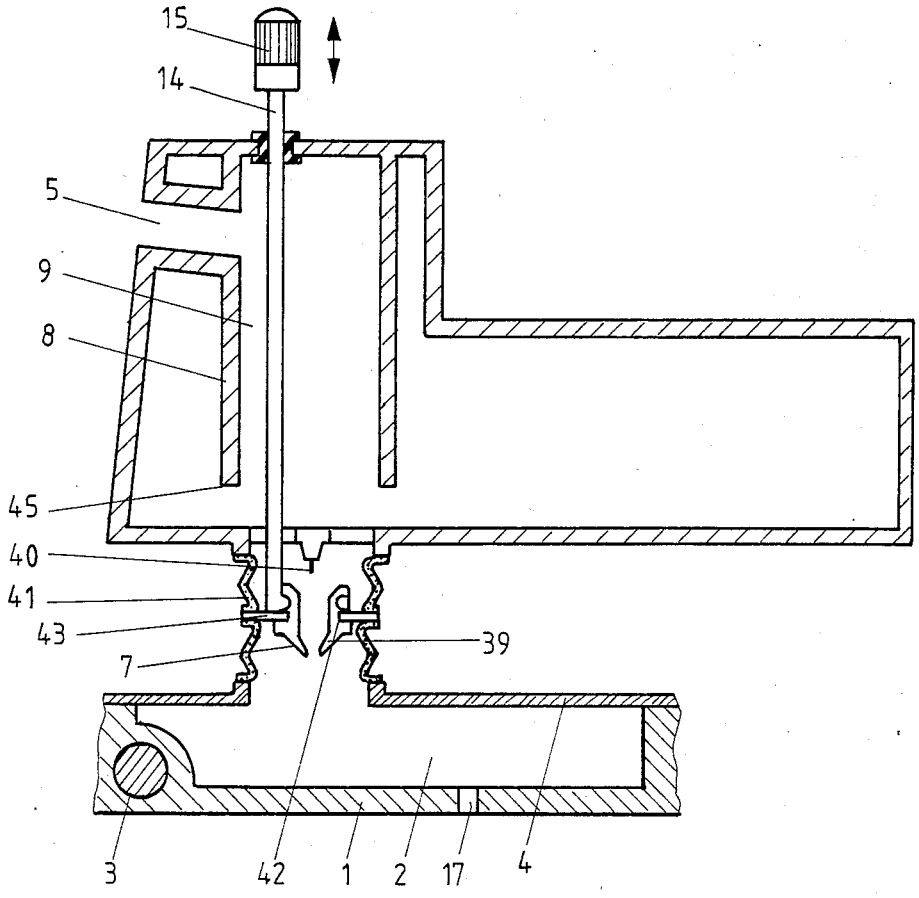

FIG. 7 shows another possible embodiment in which the inlet connection 41 of the vaporizing chamber 2 is constructed as a resiliently deformable concertina. The valve member 39 is connected to the inlet connection 41. The connection is made by means of a groove 42 provided in the valve member 39, and a bead 43 formed on the inlet connection 41 which snaps into the groove 42.

We claim:

1. An electrically heated steam iron operable by a drip system, including a drip valve, a water tank the interior of which is vertically divided into at least two chambers, two such chambers being in flow communication with each other via an opening in a partition wall, a vertically adjustable slide member arranged to slide relative to said wall in the region of said opening while being sealingly engaged with said wall, and adjustment means connected to the slide member and passing through an outer wall of the tank, wherein vertical adjustment of said slide member via said adjustment means is effective to vary the height of the column of water above the drip valve, thereby adjusting the rate of flow of water therethrough.

2. A steam iron as claimed in claim 1, wherein said adjustment means comprises a valve rod of the drip valve.

3. An electrically heated steam iron operable by a drip system, including a drip valve arranged above a vaporizing chamber, a water tank the interior of which is vertically divided by a partition wall into two chambers, said partition wall comprising a tubular member connected at one end to the top of the water tank and extending downwardly to an open end above the base of the tank such that the two chambers are in flow communication with each other, a U-shaped tube fixed to and projecting from said tank base into the tubular member, one leg of said U-shaped tube being connected to said vaporizing chamber and the other leg of the U-shaped tube having an open end above said tank base, a cylindrical valve the external diameter of which is smaller than the internal diameter of said other leg of the U-shaped tube, the cylindrical valve being movably guidable in a seal in a top surface of the U-shaped tube and the inner regions of the cylindrical valve and the tubular member being connected to one another through an opening, and adjustment means connected to the cylindrical valve and passing through an outer wall of the tank, wherein vertical adjustment of said cylindrical valve via said adjustment means is effective to vary the height of the column of water above the drip valve thereby adjusting the rate of flow of water therethrough.

4. A steam iron as claimed in claim 3, wherein the cylindrical valve is part of a valve rod of the drip valve.

5. A steam iron as claimed in claim 3 or 4, wherein the legs of the U-shaped tube comprise two tubes fixed to the tank base and projecting into the tubular member, the inner regions of these tubes being in flow communication with each other, a channel connecting one of said tubes to said vaporizing chamber, and wherein the drip valve is disposed in the tank base below the other of said tubes, the wall of said other tube having an opening in the region of the tank base, and the external diameter of said cylindrical valve being smaller than the internal diameter of said other tube.

6. A steam iron as claimed in claim 5, wherein a flexible closure seals off the tubes relative to the interior of the tank and the closure has a sealing lip which abuts on the outer surface of the cylindrical valve.

7. A steam iron as claimed in claim 3, 4 or 5, wherein said cylindrical valve is arranged to be movably guided by sliding in said seal in said top surface of the U-shaped tube.

8. An electrically heated steam iron operable by a drip system, including a drip valve, a water tank the interior of which is vertically divided into at least two chambers, two such chambers being in flow communication with each other via an opening, said drip valve including a valve chamber fixedly connected to a valve rod, said valve member being vertically adjustable in an inlet connection of a vaporizing chamber, and a valve needle of the drip valve being fixed in the wall of the water tank, wherein vertical adjustment of said valve member is effective to vary the height of the column of water above the valve member, thereby adjusting the rate of flow of water therethrough.

9. A steam iron as claimed in claim 8, wherein the inlet connection is resiliently deformable and the valve member and inlet connection are connected to each other.

* * * * *